US006877180B2

(12) United States Patent
Wilmo et al.

(10) Patent No.: US 6,877,180 B2
(45) Date of Patent: Apr. 12, 2005

(54) STREET SWEEPER MAIN BROOM CUTOFF FLAP

(75) Inventors: Michael S. Wilmo, Crystal, MN (US); Archie A. Weidner, Minnetonka, MN (US)

(73) Assignee: Tennant, Minneapolis, MN (US)

( * ) Notice: Subject to any disclaimer, the term of this patent is extended or adjusted under 35 U.S.C. 154(b) by 114 days.

(21) Appl. No.: 10/237,214

(22) Filed: Sep. 6, 2002

(65) Prior Publication Data

US 2004/0045585 A1 Mar. 11, 2004

(51) Int. Cl.[7] ..... E01H 1/08
(52) U.S. Cl. ..... 15/83; 15/82; 15/84; 15/340.3
(58) Field of Search ..... 15/84, 340.3, 82, 15/83; 134/6

(56) References Cited

U.S. PATENT DOCUMENTS

| | | | | |
|---|---|---|---|---|
| 1,238,681 A | * | 8/1917 | Kaplan | 15/84 |
| 1,817,042 A | * | 8/1931 | Spradbrow | 15/84 |
| 2,514,945 A | * | 7/1950 | Fortier | 56/328.1 |
| 3,008,542 A | | 11/1961 | Steele | |
| 3,604,051 A | | 9/1971 | Wendel et al. | |
| 3,639,940 A | | 2/1972 | Carlson et al. | |
| 3,756,416 A | | 9/1973 | Wood | |
| 3,792,569 A | | 2/1974 | Carlson et al. | |
| 3,872,657 A | * | 3/1975 | Ramacher et al. | 56/328.1 |
| 3,881,215 A | | 5/1975 | Krier et al. | |
| 3,926,596 A | | 12/1975 | Coleman | |
| 4,017,281 A | | 4/1977 | Johnstone | |
| 4,578,840 A | | 4/1986 | Pausch | |
| 4,660,248 A | | 4/1987 | Young | |
| 4,754,521 A | | 7/1988 | Zoni | |
| 4,759,781 A | | 7/1988 | Olson | |
| 5,006,136 A | | 4/1991 | Wetter | |
| 6,192,542 B1 | | 2/2001 | Frederick et al. | |
| 6,195,836 B1 | | 3/2001 | Vanderlinden | |
| 6,195,837 B1 | | 3/2001 | Vanderlinden | |

FOREIGN PATENT DOCUMENTS

| | | |
|---|---|---|
| DE | 1253242 | 12/1967 |
| DE | 1256241 | 12/1967 |
| EP | 0453177 | 4/1991 |
| WO | 03/069071 | 2/2003 |

* cited by examiner

*Primary Examiner*—Robert J. Warden, Sr.
*Assistant Examiner*—Shay L Balsis
(74) *Attorney, Agent, or Firm*—Altera Law Group, LLC

(57) ABSTRACT

A street sweeper system is used typically in a motorized vehicle. The sweeper utilizes a cylindrical brush rotating about an axis generally perpendicular to the vehicle's direction of motion. A conveyor belt catches debris thrown forwards and upward by the brush and moves the debris to a hopper. A cutoff flap is mounted contacting a front portion of the brush. The cutoff flap deflects debris that moves upwards along a front portion of the brush back downwards to be recollected at the conveyor.

20 Claims, 5 Drawing Sheets

STREET SWEEPER MAIN BROOM CUTOFF FLAP

FIELD OF THE INVENTION

The present invention relates to motorized street sweeping vehicles.

BACKGROUND OF THE INVENTION

Automated street sweeping vehicles are essential equipment for commercial and government organizations. The vehicles are used for cleaning debris from roadways, walkways, parking lots, runways, and many other ground surfaces.

For streets and highways, large sweepers are primarily used. The large sweepers are motorized (typically diesel powered) and can be custom-made or built upon a standard commercial truck chassis. The large sweepers typically include large main brushes which direct debris onto a paddled conveyor that moves the debris into a large-capacity debris hopper. The large hoppers allow the sweepers to cover greater distances without the need for emptying the hopper. The large brushes allow the sweeper to pick up larger debris (e.g. rocks, tire treads, wood pieces), thus avoiding the need for multiple passes of the sweeper or manual retrieval of the debris.

Although effective, such street sweepers often miss a certain percentage of the debris, even when the sweeper passes directly over the debris. In some cases, the debris gets caught up in the brush and passes over the top of the brush. When this happens, the debris typically falls off the back end of the brush and is ejected out the back end of the sweeper.

Such sweepers can also generate a dust cloud while in operation. Typically, suction is used on side brushes and on the conveyor to control this dust. Regardless, a significant amount of dust is ejected into the atmosphere at least at the periphery of the brushes during sweeping. Besides being a nuisance, the dust is a source of particulate air pollution. In many localities air pollution is a major problem, and some municipalities are under government mandates to reduce particulate air pollution in particular.

What is needed is a sweeper that can pick up a high percentage of road debris by preventing debris from passing over the top of the main brush. Further, the sweeper should reduce the amount of dust ejected into the air. The present invention fulfills these and other needs, and addresses other deficiencies of prior art implementations.

SUMMARY OF THE INVENTION

To overcome the limitations in the prior art described above, and to overcome other limitations that will become apparent upon reading and understanding the present specification, the present invention discloses a sweeper for a ground surface having a front end, a back end and a forward direction of motion. The sweeper includes a debris mover with an outer surface, a ground contact area, an axis of rotation, and a cutoff area on the outer surface of the debris mover. The ground contact area is defined where the outer surface of the debris mover contacts the ground surface. The debris mover rotates about the axis of rotation so that the outer surface of the debris mover moves at least in part towards the front end of the vehicle at the ground contact area. The outer surface of the debris mover moves at least in part upwards at the cutoff area as the debris mover rotates about the axis of rotation.

The sweeper further includes a debris collector mounted forward of the debris mover. A collection space is defined between the debris mover and the debris collector. A cutoff flap is mounted forward of the debris mover. The cutoff flap has a distal end adjacent the outer surface of the debris mover along the cutoff area. The cutoff flap is mounted at an angle relative to the outer surface of the debris mover so that a portion of the debris traveling to the cutoff area is deflected back into the collection space.

The distal edge of the cutoff flap may include an elongated blade, and the elongated blade may be substantially flexible. In one configuration, the elongated blade is made from belted rubber sheet.

In one arrangement, the cutoff area is located between 45 degrees and 140 degrees from the ground contact area. Also, at least a portion of the cutoff flap proximate the distal tip may be oriented between 10 degrees and 30 degrees relative to horizontal.

The sweeper may include a shroud encompassing the debris collector. A passageway is formed between a rear portion of the shroud and a front portion of the debris mover. The cutoff flap substantially covers the passageway to prevent the passage of dust therethrough.

The sweeper may be configured with a gap between the distal end of the cutoff flap and the outer surface of the debris mover. In one arrangement, the gap measures between 0 and 1 inch.

The debris mover may include a cylindrical brush having a plurality of radial bristles each having distal ends, the distal ends of the radial bristles defining the outer surface of the debris mover. In one configuration, the distal end of the cutoff flap extends substantially within the bristles of the brush. Also, the debris collector may include a conveyor, the conveyor moving the debris substantially upwards and forwards.

In another embodiment of the present invention, a method of sweeping debris involves moving a conveyance in a forward direction. A debris mover is rotated on the conveyance to push the debris at least in part in the forward direction. A portion of the debris that is moving at least in part upwards at a forward portion of the debris mover is deflected substantially downwards for recollection by the debris mover.

The method may include collecting the debris at a debris collector located forward of the debris mover to remove the debris. The method may also involve blocking airborne dust from passing though at least a portion of a passageway between the debris mover and the debris collector to prevent escape of a dust portion of the debris.

In another embodiment of the present invention, a mobile sweeping system is usable for removing debris from a ground surface. The street sweeping system has a forward direction of motion and a sweeping width. The street sweeping system further includes a debris moving means moving a debris at least in part forwards and upwards across the sweeping width. A debris collection means is mounted generally forward of the debris moving means to collect debris from the debris moving means. A cutoff means is adjacent to a forward portion of the debris moving means where an outer surface of the debris moving means is moving at least in part upwards. The cutoff means deflects a portion of the debris passing upwards along the outer surface of the debris moving means substantially downwards.

The sweeping system may include shroud means encompassing at least part of the debris collection means. The cutoff means forms an air restriction between the debris moving means and the shroud means. The restriction prevents release of a portion of airborne dust of the debris therethrough. The sweeping system may also include an air moving means drawing air away from a passageway between the debris moving means and the shroud means. The air restriction between the debris moving means and the shroud means traps the airborne dust for collection by the air moving means.

In one configuration, the sweeping system further includes a gap between the cutoff means and the outer surface of the debris moving means. A distal portion of the cutoff means may substantially penetrate beneath the outer surface of the debris moving means. The collecting means may include conveyor means for moving the collected debris into a hopper.

The above summary of the present invention is not intended to describe each embodiment or every implementation of the present invention. Advantages and attainments, together with a more complete understanding of the invention, will become apparent and appreciated by referring to the following detailed description and claims taken in conjunction with the accompanying drawings.

Figure 1:
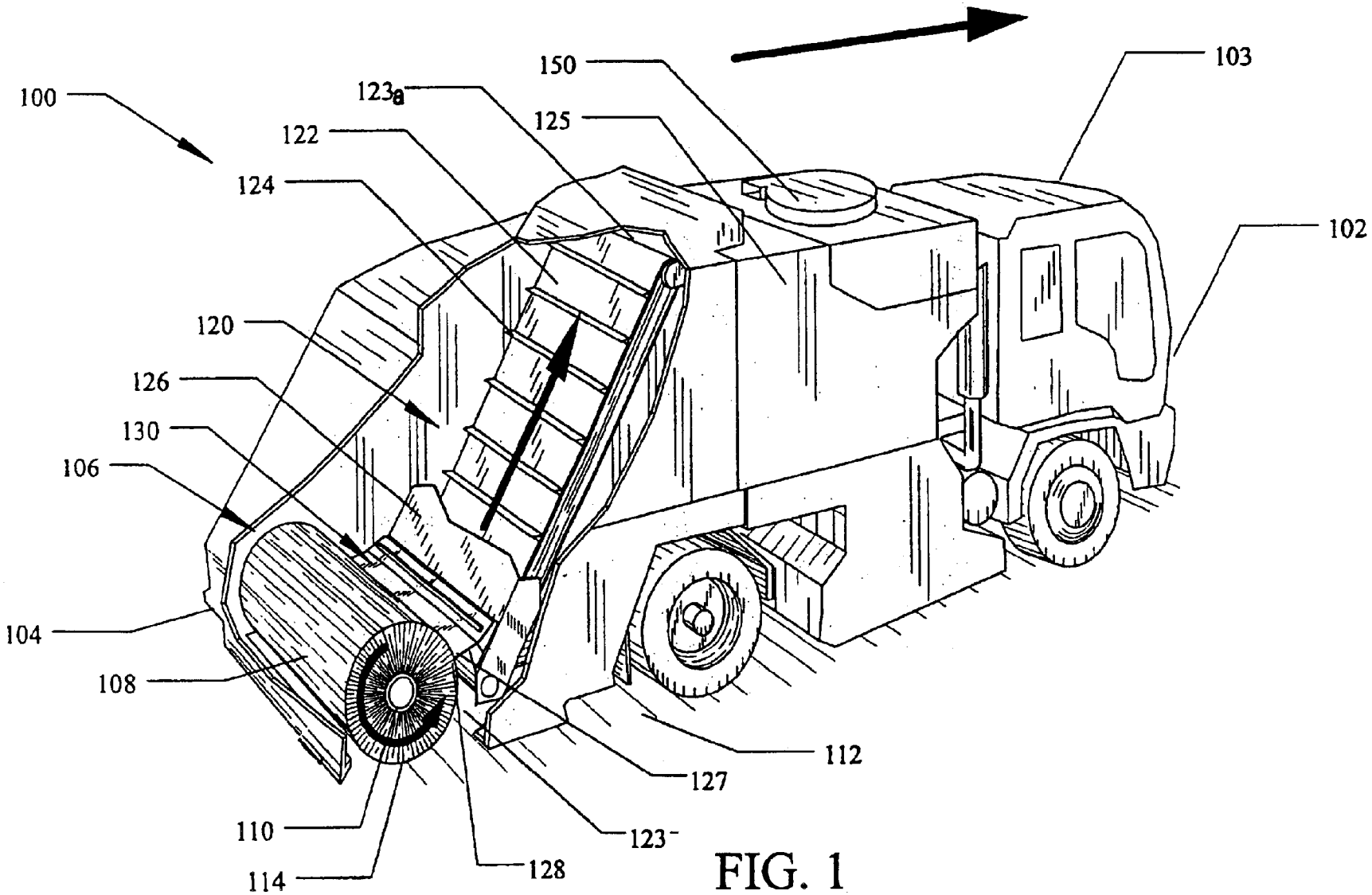
FIG. 1 is a cutaway perspective view of a street sweeper vehicle according to an embodiment of the present invention.

While the invention is amenable to various modifications and alternative forms, specifics thereof have been shown by way of example in the drawings and will be described in detail herein. For example, while the title describes a street sweeper, this refers only to a preferred embodiment since the present invention is applicable to all forms of debris gathering equipment. It is to be understood, however, that the intention is not to limit the invention to the particular embodiments described. On the contrary, the invention is intended to cover all modifications, equivalents, and alternatives falling within the scope of the invention as defined by the appended claims.

DETAILED DESCRIPTION OF THE VARIOUS EMBODIMENTS

In the following description of the illustrated embodiments, references are made to the accompanying drawings which form a part hereof, and in which is shown by way of illustration, various embodiments in which the invention may be practiced. It is to be understood that other embodiments may be utilized, and structural and functional changes may be made without departing from the scope of the present invention.

Referring now to FIG. 1, a street sweeping vehicle, generally indicated by reference numeral 100, has a front end 102 and back end 104. The front end 102 of the vehicle includes a cab section 103 where an operator sits. A cylindrical debris mover (typically a brush), generally indicated by reference numeral 106 is mounted near the back end 104 of the vehicle 100. The brush 106 includes bristles 108 and a hub 110. The centerline of the brush 106 is preferably substantially perpendicular to the direction of forward motion of the vehicle 100, forward motion being indicated by the bold, straight arrow above the vehicle 100. It is appreciated, however, that the brush 106 can be oriented skewed (i.e. non-perpendicular to forward motion) to push debris both forwards and sideways.

The brush 106 is powered and rotates in the direction indicated by the bold, curved arrow. It is appreciated that the brush 106 can be rotated opposite the direction indicated in FIG. 1, although such a rotation is likely to be less effective. The brush 106 can rotate at varying speeds, typically in the range of 75 to 150 rpm. The brush 106 in this example has an outer diameter ranging from 36 to 18 inches (91 to 45 cm), the outer diameter typically decreasing with wear of the bristles 108. Alternative pickup elements other than a brush are possible so long as the pickup element has the capability to pickup debris and resist wear while contacting the debris and a ground surface 112.

The outer surface of the brush 106 (i.e. at the tip of the bristles 108) contacts the ground surface 112 at a contact area 114. The brush 106 throws debris from the ground surface 112 into a collection space 123, where the debris lands on a debris collector (e.g. conveyor), generally indicated by reference numeral 120. The conveyor 120 includes a belt 122 with paddles 124 mounted along an outer surface at regularly spaced intervals. The belt 122 rotates such that the debris is carried upwards and forwards away from the brush 106, as indicated by the angled arrow located over the belt 122. The debris leaves the top of the conveyor 120 at an exit portion 123*a* and drops into a hopper 125. A shroud 126 covers a top portion of the conveyor 120 and helps contain dust and debris as the debris is moved upwards by the conveyor belt 122.

In the sweeping vehicle 100 according to the present invention, a cutoff plate or flap 130 is mounted on the vehicle 100 forward of the brush 106. In this example, the cutoff flap 130 is attached to the conveyor shroud 126. It is possible to attach the cutoff flap 130 to any structure allowing the flap 130 to be adjacent the brush 106. The cutoff flap 130 includes a distal end 127 that is adjacent the outer surface of the brush 106 at a cutoff area 128. The cutoff area 128 is located on a portion of the brush's outer surface that is moving substantially upwards as the brush 106 rotates.

Conceptually, the cutoff flap 130 is a structural element that counteracts the tangential trajectory of debris being moved by the brush 106 or other debris moving device. By forcing the debris back into the collection space 123, the debris will recirculated and thereby eventually be removed at the debris collector 120. In broad terms, the flap 130 is constructed to provide a barrier to debris having a trajectory that would carry it upwards over the brush.

Figure 2:
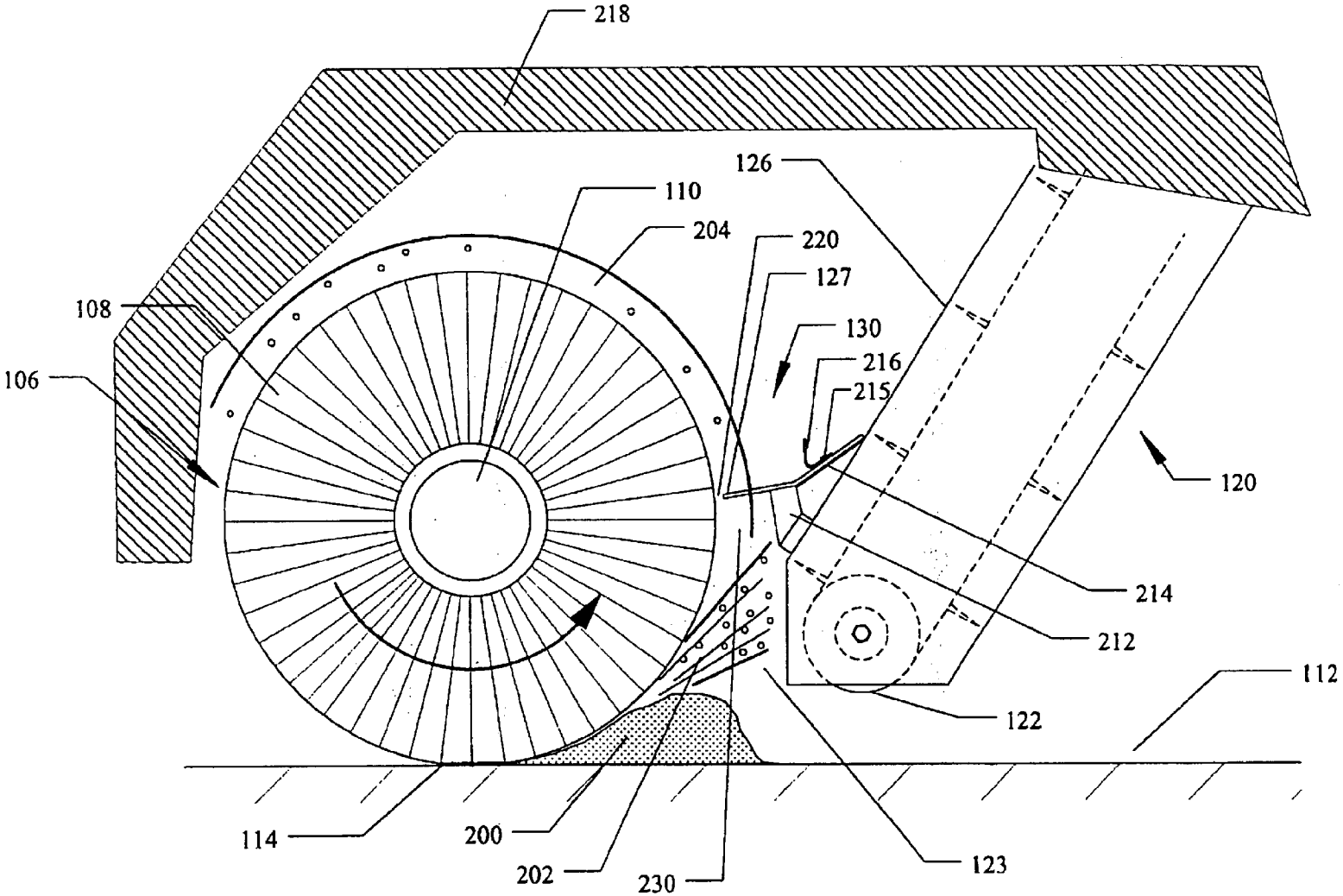
FIG. 2 is a side view of the brush, conveyor and cutoff flap according to an embodiment of the present invention.

Turning now to FIG. 2, a side view of the sweeping system illustrates the benefits of the cutoff flap 130. The brush 106 contacts the ground at the contact area 114 as the brush 106 is being rotated in the direction indicated by the curved arrow. The rotation of the brush 106 tends to build up a "wedge" 200 of debris at the contact area 114 as the vehicle 100 moves forward. Most of the debris in the wedge 200 is flung into the collection space 123 in a debris path 202 tangential to the brush 106 originating where the brush 106 contacts a top portion of the wedge 200. Debris can become trapped in the bristles 108 or otherwise be carried over the top of the brush hub 110, exemplified by debris path 204.

Debris that is carried over the top of the brush 106 in prior art sweepers will usually be ejected from behind the brush 106 and therefore missed by the sweeper. By including the cutoff flap 130, the debris is defected substantially downwards so that the debris can be returned to the collection space 123, and eventually be recovered at the conveyor 120.

The cutoff flap 130 in the illustrated embodiment is formed as an elongated blade fixably attached to an angle bracket 212 and a mounting plate 214. A retainer bracket 216 clamps the cutoff flap 130 to the mounting plate 214. The retainer bracket 216 may have an angular cross section to further stiffen the cutoff flap 130 and angle bracket 212.

The angle bracket 212 orients the distal end 127 of the cutoff flap 130 to the desired angle relative to the brush 106. The angle bracket 212 also positions the cutoff flap 130 so that there is a gap 220 between the distal tip 127 and the outer surface of the brush 106 (i.e. at the tip of the bristles 108). In most applications, the gap 220 is desired to reduce vibrations and wear on the brush 106 and cutoff flap 130. In some applications, however, it may be beneficial to allow the distal tip 127 to touch the brush 106 (i.e. gap 220 size is zero), or arrange the cutoff flap 130 so that the distal tip 127 protrudes through the brush's outer surface to extend into the bristles 108.

The cutoff flap 130 is preferably made adjustable (e.g. by using elongated mounting slots) thereby allowing the user to adjust the gap 220 to keep it a desired value given various stages of brush wear. The cutoff flap 130 is preferably made from a flexible material, such as rubber or plastic. A cutoff flap 130 using a rigid blade may also be constructed, although the associated gap 220 would typically need to be larger to prevent flap damage due to deflecting large objects or inadvertent contact with the brush 106.

It is appreciated that other embodiments of the cutoff flap 130 may constructed to deflect debris back into the brush 106. In some applications, the distal edge 127 of the cutoff flap 130 may be non-linear (e.g. curved or jagged). The cutoff flap 130 may have components that are non-planar, such as a blade portion that is formed from an elongated member with curved cross sectional shape. A cutoff flap 130 with a curved cross section may, for example, be shaped so that a portion near the distal edge 127 is substantially tangent to the brush's outer surface.

It is appreciated that the cutoff flap 130 helps reduce the release of airborne dust particles from the sweeper 100. A housing 218 encloses at least a portion of the brush 106 and the collection space 123. The cutoff flap is 130 positioned at a passage 230 between the rear of the conveyor shroud 126 and a front portion of the brush 106. The cutoff flap 130 closes at least part of the passage 230 along the width of the brush 106, thereby preventing the release of dust therefrom. The dust that is contained by the cutoff flap 130 can then be removed by a vacuum system 150 (best seen in FIG. 1). The vacuum system 150 pulls air up through the conveyor 120.

Figure 3A:
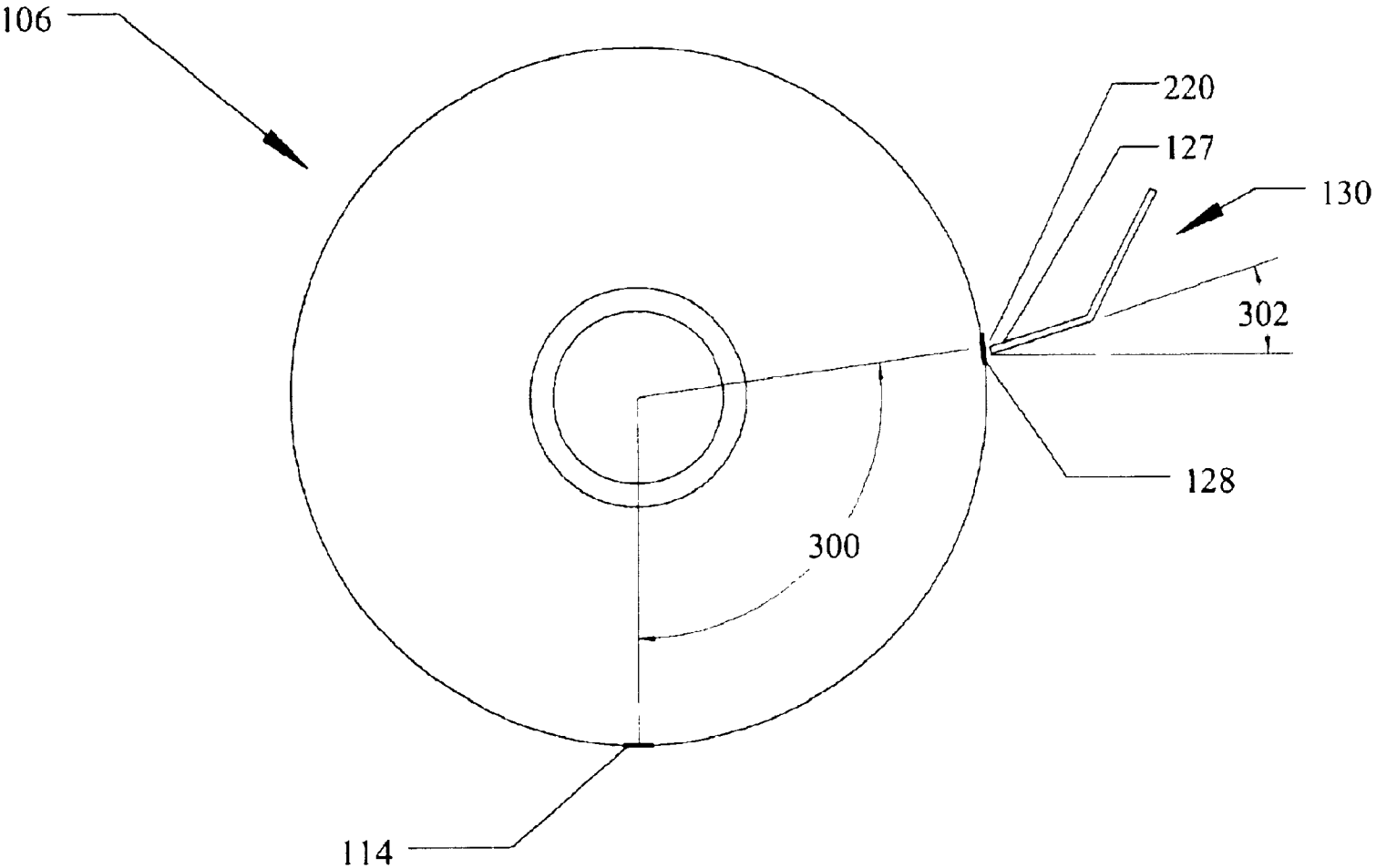
FIG. 3A is a side view of the brush and cutoff flap showing geometric details according the an embodiment of the present invention.

A particular useful arrangement of a cutoff flap 130 and brush 106 are shown in FIG. 3A. The distal tip 127 of the cutoff flap 130 is adjacent the brush at the cutoff area 128. The cutoff area 128 is preferably located at an angle 300 measuring between 45 degrees (or less) to 140 degrees (preferably 94 degrees) from the ground contact area 114. For a brush 106 with a nominal outer diameter of 35.5 inches (90.2 cm), this corresponds to locating the tip 215 of the cutoff flap 130 about 20.0±1.0 inches (51.0±2.0 cm) above ground. The cutoff flap 130 is typically oriented at a mounting angle 302 measuring between 10 degrees and 30 degrees from horizontal, preferably about 23±1 degrees. In this application, the gap 220 ranges from 0.0 inches to 1.0 inch (2.50 cm) or more, preferably 0.75±0.10 inches (1.91±0.25 cm).

It is appreciated that the nominal brush diameter of 35.5 inches (90.2 cm) used in this example is that of an unworn brush 106. The diameter of a brush 106 may decrease to approximately 19 inches (48 cm) or less due to normal wear. The brush 106 is attached to a drive mechanism (not shown) at the hub 110, typically a swing-down drive arm. The drive arm will adjust the brush position for wear in order to keep the brush 106 in contact with the ground. Given the changing brush diameter and adjustments of the drive arm, the orientation of the cutoff flap 130 to the brush 106, as well as the size of the gap 127, may change from the values described above. Regardless, the cutoff flap 130 has been found to be beneficial through the entire wear range of the brush 106.

Figure 3B:
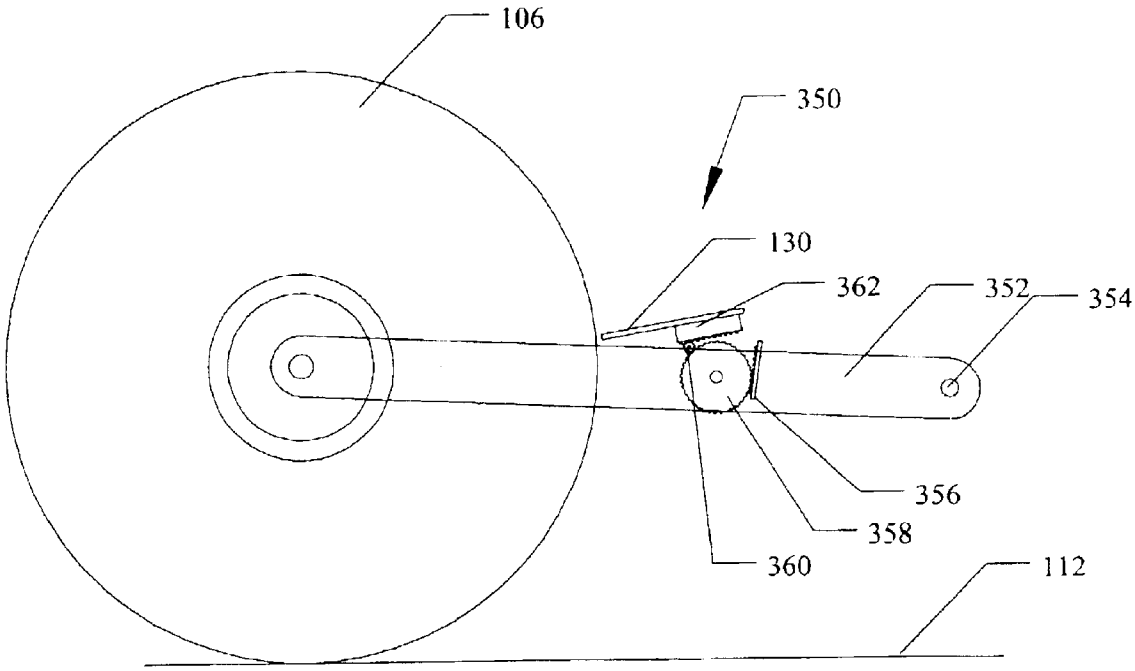
FIG. 3B is a side view of a cutoff flap adjustment mechanism according to an embodiment or the present invention.
Figure 3C:
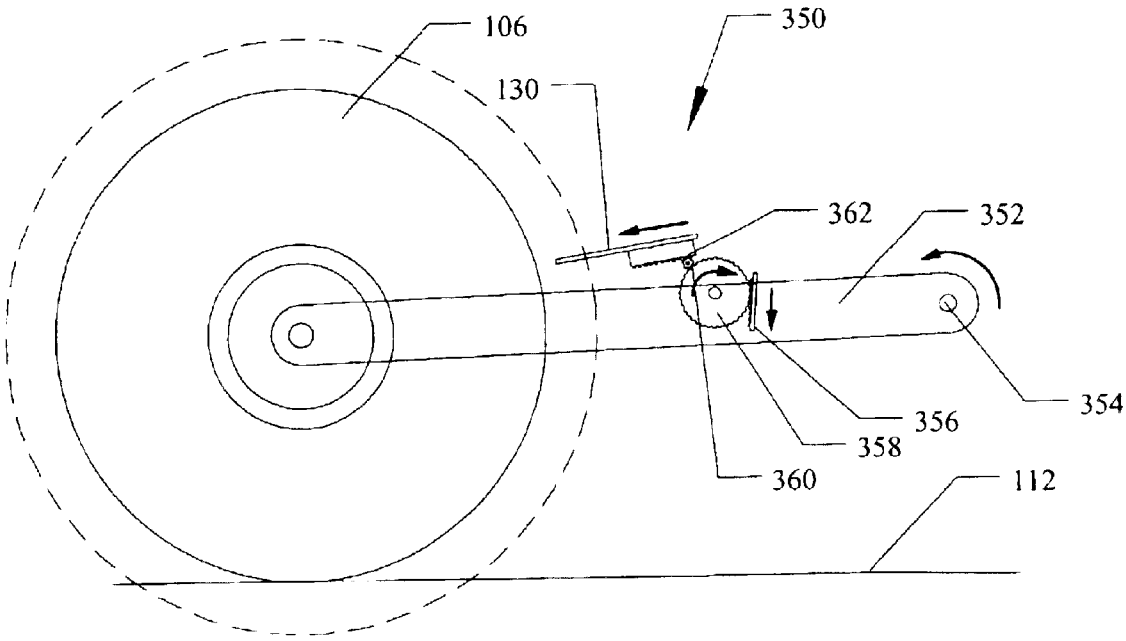
FIG. 3C is a side view of the cutoff flap adjustment mechanism of FIG. 3B showing the orientation with a worn brush.

Of course, means can be provided to move the flap 130 so as to maintain a constant gap 220, or maintain contact with the brush 106. An example of one such adjusting means includes an adjustment mechanism, generally indicated by reference 350, as shown in FIGS. 3B and 3C. In FIG. 3B, the brush 106 is shown in an unworn state. The brush 106 is supported by a drive arm 352 which rotates about an axis 354 to raise and lower the brush 106. The drive arm 352 allows the brush 106 to be lifted off of the ground surface 112 as well as adjusting for brush wear.

The adjustment mechanism 350 includes a drive arm linear gear 356. The drive arm linear gear 356 meshes with a drive gear 358 that in turn meshes with a reduction gear 360. The reduction gear 360 meshes with a cutoff flap linear gear 362 that is attached to the cutoff flap 130. The adjustment mechanism 350 also includes additional structure well known in the art (and therefore not shown) such as support brackets for the gears and linear bearings for the cutoff flap 130 and cutoff flap linear gear 362.

In FIG. 3C, the brush 106 is shown in a worn state. The unworn brush diameter of FIG. 3B is shown in broken lines to show that the brush wear has caused the drive arm 352 to move downward. Downward motion of the drive arm 352 (e.g. counterclockwise rotation about the axis 354 as seen in this view) causes clockwise rotation of the drive gear 358 as shown in the curved arrow. In turn, the reduction gear 360 will turn counterclockwise, thereby moving the cutoff flap linear gear 362 towards the brush's outer surface as shown by the arrow over the cutoff flap 130.

Although the adjustment mechanism 350 shown in FIGS. 3B and 3C uses gears, it is appreciated other means of adjusting the cutoff flap 130 possible. Fully mechanical devices such as rods, levers, screws, etc can be used to automatically position the cutoff flap 130. Alternatively, electromechanical of hydromechanical devices such as motors or actuators can be used to move the cutoff flap 160. Such devices are controllable by mechanical or electrical control systems, and can use sensors to determine brush wear and/or gap size.

Figure 4:
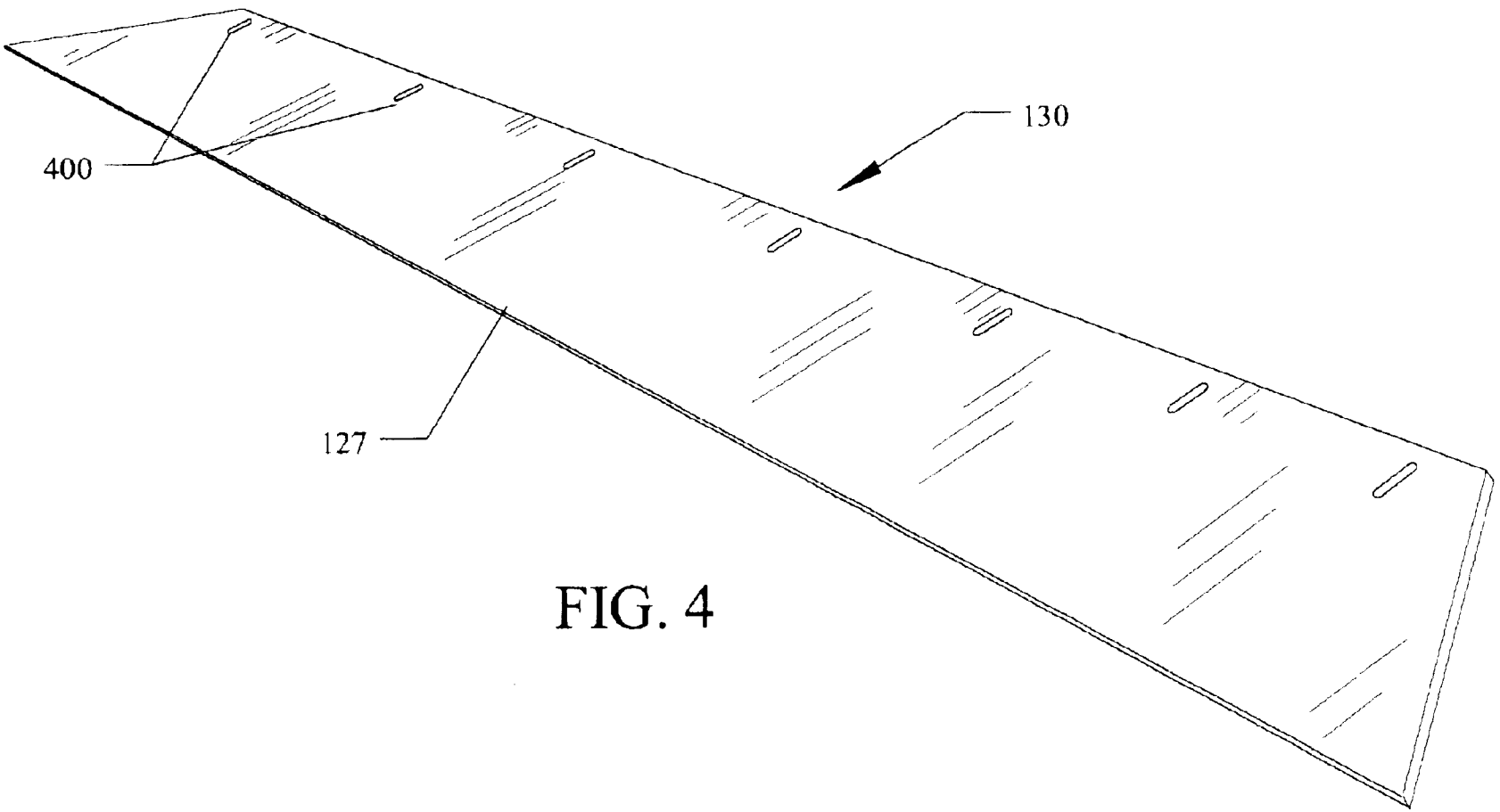
FIG. 4 is a perspective view of the cutoff flap according to an embodiment of the present invention.

Turning now to FIG. 4, a particularly useful embodiment of a cutoff flap 130 is shown. The cutoff flap 130 is best made of two- or three-ply sheet rubber product such as ⅜ inch (0.95 cm) thick Goodyear Plylon® (220B 3/16×1/16, Class I). Making the elongated blade 214 from relatively flexible rubber helps prevent damage caused by deflecting heavy objects and inadvertent contact with the brush 106. In another embodiment, the cutoff flap 130 can be made of a rubber blade portion attached to a rigid portion made of metal or some other suitable material. The rigid portion is attachable to the mounting structures of the vehicle 100.

The cutoff flap 130 can be attached to the mounting plate 214 using the retainer bracket 216 and standard fasteners 215 (best seen in FIG. 2) that pass through mounting slots 400 in the flap 130. The retainer bracket 216 can be formed of angled sheet metal to further stiffen the mounting plate 214 and cutoff flap 160.

The retainer bracket 216, angle bracket 212 and mounting plate 214 can be formed from sheet metal, typically 0.10 inch (2.5 mm) thick carbon steel. An equivalent strength aluminum or magnesium material may be used where low weight or corrosion resistance is desired.

Although the sweeping system of the present invention has been described in conjunction with a self propelled vehicle 100, it is appreciated that a brush 106, conveyor 120, and cutoff flap 130 can be used in any conveyance, such as trailers or push sweepers. The cutoff flap 130 can also be used on smaller sweeping systems that have alternate conveyor 120 embodiments or sweeping systems that do not include conveyors (e.g. debris is swept directly into a hopper).

It will, of course, be understood that various modifications and additions can be made to the preferred embodiments discussed hereinabove without departing from the scope of the present invention. Accordingly, the scope of the present invention should not be limited by the particular embodiments described above, but should be defined only by the claims set forth below and equivalents thereof.

What is claimed is:

1. A sweeper for a ground surface having a front end, a back end and a forward direction of motion, the sweeper comprising:

a debris mover comprising:

an outer surface;

a ground contact area defined where the outer surface of the debris mover contacts the ground surface;

an axis of rotation in a direction opposite the direction of sweeper motion, the debris mover rotating about the axis of rotation so that the outer surface of the debris mover moves at least in part towards the front end of the vehicle at the ground contact area; and a cutoff area on the outer surface of the debris mover, the outer surface of the debris mover moving at least in part upwards at the cutoff area as the debris mover rotates about the axis of rotation;

a vacuumized debris collector mounted forward of the debris mover and having a moving portion with an upwardly moving path;

a collection space defined between the debris mover and the debris collector; and a substantially non-contacting cutoff flap mounted forward of the debris mover, the cutoff flap having a distal end adjacent the outer surface of the debris mover along the cutoff area, the cutoff flap mounted at an angle relative to the outer surface of the debris mover so that a portion of the debris traveling to the cutoff area is deflected back into the collection space, said cutoff flap being located adjacent said upwardly moving path.

2. The sweeper of claim 1, wherein the distal edge of the cutoff flap comprises an elongated blade.

3. The sweeper of claim 2, wherein the elongated blade is substantially flexible.

4. The sweeper of claim 2, wherein the elongated blade is made from belted rubber sheet.

5. The sweeper of claim 1, wherein the cutoff area is located between 45 degrees and 140 degrees from the ground contact area.

6. The sweeper of claim 1, wherein at least a portion of the cutoff flap having a distal tip oriented between 10 degrees and 30 degrees relative to horizontal.

7. The sweeper of claim 1, further comprising a shroud encompassing the debris collector, a passageway formed between a rear portion of the shroud and a front portion of the debris mover, and wherein the cutoff flap substantially covers the passageway to prevent the passage of dust therethrough.

8. The sweeper of claim 1, further comprising a gap between the distal end of the cutoff flap and the outer surface of the debris mover.

9. The sweeper of claim 8, wherein the gap measures generally greater than 0 and generally less than 1 inch.

10. The sweeper of claim 1, wherein the debris mover comprises a cylindrical brush having a plurality of radial bristles each having distal ends, the distal ends of the radial bristles defining the outer surface of the debris mover.

11. The sweeper of claim 1, wherein the debris collector comprises a conveyor, the conveyor moving the debris substantially upwards and forwards.

12. A method of sweeping a debris, comprising:

moving a conveyance in a forward direction;

rotating a debris mover on the conveyance to push the debris at least in part in the forward direction;

deflecting a portion of the debris that is moving at least in part upwards at a forward portion of the debris mover to deflect the debris substantially downwards for recollection by the debris mover and vacuumizing at least part of the environment along the upward path to draw debris deflected downwardly.

13. The method of claim 12, further comprising collecting the debris at a debris collector located forward of the debris mover to remove the debris.

14. The method of claim 13, further comprising blocking an airborne dust from passing though at least a portion of a passageway between the debris mover and the debris collector to prevent escape of a dust portion of the debris.

15. A mobile sweeping system for removing a debris from a ground surface, the street sweeping system having a forward direction of motion and a sweeping width, the street sweeping system further comprising:

a debris moving means moving a debris at least in part forwards and upwards across the sweeping width and rotating against the direction of motion;

a vacuumized debris collection means mounted generally forward of the debris moving means to collect debris from the debris moving means; and a substantially non-contacting cutoff means adjacent to a forward portion of the debris moving means where an outer surface of the debris moving means is moving at least in part upwards and said cutoff flap being located adjacent said upwardly moving surface, the cutoff means deflecting downwards a portion of the debris passing upwards along the outer surface of the debris moving means.

16. The sweeping system of claim 15, wherein the cutoff means forms an air restriction between the debris moving means and the debris collection means, the restriction preventing release of a portion of an airborne dust of the debris therethrough.

17. The sweeping system of claim 16, further comprising air moving means drawing air away from a passageway between the debris moving means and the debris collection means, and wherein the air restriction between the debris moving means and the debris collection means traps the airborne dust for collection by the air moving means.

18. The sweeping system of claim 15, further comprising a gap between the cutoff means and the outer surface of the debris moving means.

19. The sweeping system of claim 15, wherein a distal portion of the cutoff means substantially penetrates beneath the outer surface of the debris moving means.

20. The sweeping system of claim 15, wherein the collecting means comprises conveyor means for moving the collected debris into a hopper.

* * * * *